US008511015B2

(12) United States Patent
Behrens

(10) Patent No.: US 8,511,015 B2
(45) Date of Patent: Aug. 20, 2013

(54) MOBILE PARTITION

(75) Inventor: Jan-Gerd Behrens, Oldenburg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 503 days.

(21) Appl. No.: 12/083,168

(22) PCT Filed: Sep. 12, 2006

(86) PCT No.: PCT/EP2006/008853

§ 371 (c)(1),
(2), (4) Date: Apr. 7, 2008

(87) PCT Pub. No.: WO2007/039043

PCT Pub. Date: Apr. 12, 2007

(65) Prior Publication Data

US 2009/0223141 A1 Sep. 10, 2009

(30) Foreign Application Priority Data

Oct. 6, 2005 (DE) ..... 10 2005 048 155

(51) Int. Cl.
*E04H 1/00* (2006.01)

(52) U.S. Cl.
USPC ..... 52/238.1; 52/64; 52/243.1; 52/240; 49/501; 49/130

(58) Field of Classification Search
USPC ..... 52/64, 235, 36.4, 243.1, 238.1, 240, 52/241; 160/135; 49/501, 409, 125, 127, 49/128, 130
See application file for complete search history.

(56) References Cited

U.S. PATENT DOCUMENTS

| | | | | |
|---|---|---|---|---|
| 3,049,195 | A * | 8/1962 | Leat et al. | 52/126.4 |
| 3,072,975 | A * | 1/1963 | Burmeister | 49/317 |
| 3,110,131 | A * | 11/1963 | Jeffress | 52/396.04 |
| 3,226,777 | A * | 1/1966 | Kollsman | 49/130 |
| 3,295,257 | A * | 1/1967 | Douglass | 49/317 |
| 3,309,916 | A | 3/1967 | Maline, Jr. | |
| 3,335,532 | A * | 8/1967 | Greenbie | 52/126.4 |
| 3,341,992 | A * | 9/1967 | Piper | 52/243.1 |
| 3,387,418 | A * | 6/1968 | Tyrer | 52/242 |
| 3,400,504 | A * | 9/1968 | Neisewander | 52/126.3 |
| 3,557,499 | A * | 1/1971 | Dickie | 52/36.4 |

(Continued)

FOREIGN PATENT DOCUMENTS

| | | |
|---|---|---|
| AT | 324 638 | 9/1975 |
| AT | 325 262 | 10/1975 |

(Continued)

OTHER PUBLICATIONS

Search Report date Dec. 28, 2006 issued for the underlying International PCT Application No. PCT/EP2006/008853.

*Primary Examiner* — Robert Canfield
*Assistant Examiner* — Matthew Gitlin
(74) *Attorney, Agent, or Firm* — Cozen O'Connor

(57) ABSTRACT

The invention relates to a mobile partitioning wall with several wall elements suspended at running rails. In order to provide a mobile partitioning wall, which is designed to be simple to manufacture and to mount and to be universally applicable, and offers simple and variable possibilities to be optionally completed with add-on parts, the wall elements are formed without supporting frame, and mounting elements are horizontally and/or vertically disposed at the edge sides of the wall elements.

16 Claims, 9 Drawing Sheets

(56) References Cited

U.S. PATENT DOCUMENTS

| | | | | | |
|---|---|---|---|---|---|
| 3,587,205 | A | * | 6/1971 | Gartside | 52/64 |
| 3,614,050 | A | * | 10/1971 | Greenhalgh | 249/26 |
| 3,638,376 | A | * | 2/1972 | Howes et al. | 52/126.4 |
| 3,755,968 | A | * | 9/1973 | Williams | 49/489.1 |
| 3,798,839 | A | | 3/1974 | Kaufman | |
| 3,967,420 | A | * | 7/1976 | Papsco et al. | 52/243.1 |
| 4,031,664 | A | * | 6/1977 | Wendt | 49/409 |
| 4,073,092 | A | | 2/1978 | Williams | |
| 4,084,367 | A | * | 4/1978 | Saylor et al. | 428/113 |
| 4,086,734 | A | * | 5/1978 | Hayashi | 52/126.4 |
| 4,102,089 | A | * | 7/1978 | Paisley | 52/36.5 |
| 4,103,463 | A | * | 8/1978 | Dixon | 52/126.4 |
| 4,227,355 | A | * | 10/1980 | Wendt | 52/64 |
| 4,263,761 | A | * | 4/1981 | Kristoff | 52/241 |
| 4,277,920 | A | * | 7/1981 | Dixon | 52/64 |
| 4,395,854 | A | * | 8/1983 | White et al. | 52/64 |
| 4,443,978 | A | * | 4/1984 | Butler | 52/1 |
| 4,454,690 | A | * | 6/1984 | Dixon | 52/126.3 |
| 4,535,578 | A | | 8/1985 | Gerken | |
| 4,612,744 | A | * | 9/1986 | Shamash | 52/220.1 |
| 4,833,840 | A | * | 5/1989 | Kalischewski et al. | 52/64 |
| 5,214,889 | A | * | 6/1993 | Nienhuis et al. | 52/220.7 |
| 5,301,468 | A | | 4/1994 | Kamezaki | |
| 5,471,791 | A | * | 12/1995 | Keller | 49/317 |
| 5,481,834 | A | * | 1/1996 | Kowalczyk et al. | 52/64 |
| 5,577,348 | A | * | 11/1996 | Keller | 49/317 |
| 5,603,192 | A | * | 2/1997 | Dickson | 52/238.1 |
| 5,634,305 | A | * | 6/1997 | Erlanger | 52/235 |
| 6,079,174 | A | * | 6/2000 | Williams et al. | 52/243.1 |
| 6,082,053 | A | * | 7/2000 | Bischof et al. | 52/64 |
| 6,112,466 | A | | 9/2000 | Smith et al. | |
| 6,141,926 | A | * | 11/2000 | Rossiter et al. | 52/239 |
| 6,233,878 | B1 | | 5/2001 | Krähenbühl et al. | |
| 6,374,456 | B1 | * | 4/2002 | Fort et al. | 16/96 R |
| 6,449,905 | B2 | | 9/2002 | Maki | |
| 6,581,332 | B1 | | 6/2003 | Kim | |
| 6,647,652 | B1 | * | 11/2003 | Seiber et al. | 40/606.1 |
| 6,711,871 | B2 | * | 3/2004 | Beirise et al. | 52/782.1 |
| 6,715,530 | B2 | * | 4/2004 | Goldsmith et al. | 160/199 |
| 6,729,085 | B2 | * | 5/2004 | Newhouse et al. | 52/239 |
| 6,754,998 | B2 | * | 6/2004 | Diffrient et al. | 52/239 |
| 7,213,632 | B1 | * | 5/2007 | Goldstein et al. | 160/135 |
| 7,603,821 | B2 | * | 10/2009 | Eberlein et al. | 52/239 |
| 7,712,270 | B2 | * | 5/2010 | Guevremont | 52/235 |
| 2001/0029713 | A1 | * | 10/2001 | Beck et al. | 52/239 |
| 2002/0129574 | A1 | * | 9/2002 | Newhouse et al. | 52/239 |
| 2002/0157335 | A1 | * | 10/2002 | Vos | 52/238.1 |
| 2004/0003556 | A1 | * | 1/2004 | Zerbst | 52/220.7 |
| 2004/0177573 | A1 | * | 9/2004 | Newhouse et al. | 52/239 |
| 2008/0209827 | A1 | * | 9/2008 | Webb | 52/220.7 |
| 2009/0077895 | A1 | | 3/2009 | Tshai | |
| 2009/0255193 | A1 | * | 10/2009 | Behrens et al. | 52/64 |
| 2009/0260292 | A1 | | 10/2009 | Hansch | |

FOREIGN PATENT DOCUMENTS

| | | | |
|---|---|---|---|
| DE | 24 04 784 | | 8/1975 |
| DE | 299 03 466 | | 6/1999 |
| DE | 299 03 466 | | 7/1999 |
| EP | 200491 | A1 * | 11/1986 |
| EP | 1 249 548 | | 10/2002 |

* cited by examiner

MOBILE PARTITION

CROSS REFERENCE TO RELATED APPLICATIONS

This is a U.S. national stage of International Application No. PCT/EP2006/008853, filed on 12 Sep. 2006. Priority is claimed on German Application No. 10 2005 048 155.8, filed on 6 Oct. 2005.

BACKGROUND OF THE INVENTION

1. Field of the Invention

The invention is based on a mobile partitioning wall having several wall elements, which are displaceably disposed at a running rail.

2. Description of the Related Art

A mobile partitioning wall with several wall elements, which are displaceably guided in a running rail, is known from DE-OS 24 04 874. Each wall element has a supporting structure, which is formed by a surrounding frame consisting of profiles. Covering panels are mounted on both sides of the frame and, moreover, additional add-on and accessory parts are attached thereto. The hollow space between the covering panels and the frame is filled with thermally insulating and sound-absorbent materials.

The frame-based supporting structure results in wall elements having a high weight and requires therefore suspension devices with a correspondingly stable configuration. With such a structure, the increasing requirements with regard to thermal and sound-insulation can only be satisfied, when using additional or thicker covering panels, while increasing the overall weight.

As mobile partitioning walls, due to varying installation situations and dimensions, are individually manufactured, in particular the realization of the frame requires an expensive and precise dimensional manufacturing and connection of profiles. A provision and production of standardized components for such wall elements is possible to a very limited extent only.

Moreover, integrating optional structural elements into such wall elements requires an exact definition of the interfaces to the frame. For example, the usual equipment of the wall elements, with sealing mechanisms on the top and bottom sides is expensive and, due to structural circumstances of a frame, restricted with regard to the universal application. Variants in the structure or the installation situation require an individual fabrication again. Modifications on-site are only possible within the given tolerance.

EP 0 629 752 B1 describes a mobile partitioning wall, in which upper and lower terminal strips are activated by pneumatic lifting members for the purpose of sound insulation and for guaranteeing the stability of the individual wall elements. Complicated manufacturing and limited repair possibilities are caused by the central disposition of the lifting mechanism within the respective wall element and, using said mechanism in a transparent wall, results in a negative appearance.

The partitioning wall elements in the Austrian patent specification AT 325262 consist of different materials. In order to achieve a high sound insulation, the gap to a floor guiding rail and the gap to a running rail respectively to the ceiling are closed by a profile being movable upwards and out of the floor guiding rail.

SUMMARY OF THE INVENTION

The object of the invention is to provide a mobile partitioning wall with several wall elements displaceably suspended at running rails, which has a simple manufacturing and mounting technique, and is designed to be universally applicable, and provides simple and variable possibilities for optional completion with add-on parts.

According to the invention, the wall elements are formed without a supporting frame, and mounting elements are disposed horizontally and/or vertically at the edges of the wall elements. The invention being applicable to both automatically and manually displaceable wall elements of partitioning walls.

The mobile partitioning wall according to the invention has the advantage that, on account of the inventive self-supporting configuration of the wall elements, manufacturing and mounting are considerably simplified. Unlike the already known supporting frame structure, a panel-shaped and layered composite structure in sandwich technique allows for a simple and extensively automated manufacturing.

With the wall elements, the add-on parts are disposed at the edge sides, because any intervention in the surface plane is avoided and the advantageous, in particular sound-insulating and weight-reducing properties of the layered structure are not altered. Such add-on parts have a modular design and they are mounted as pre-fabricated structural units to mounting elements, which are disposed at horizontal and/or vertical edges of the wall element.

Preferably, the mounting elements have a uniform basic structure for all variants and application purposes and are manufactured and kept in stock in an excess length. When realizing the wall elements, the mounting elements are cut to the corresponding length, mounted and equipped with modular structural units. Thus, the expensive manual individual assembly at/in the wall element is thus foregone.

The mounting elements, on the side of the edges, are either disposed to be concealed within a recess in the wall element or they are surface-mounted on the respective edge of the wall element. By disposing the mounting element in a recess, it becomes completely invisible. In the surface-mounted embodiment, the positioning and fastening is realized without forming a recess. Positively cooperating contours between the mounting element and the recess respectively the edge are particularly advantageous, because this achieves an additional anchoring of the mounting elements in addition to the fastening described hereinafter.

Preferably, the fastening of the mounting elements is realized such as to be integral with the layer-forming structure of the wall elements, because, on the one hand, the establishing of a core of the wall element is used to form a recess and, on the other hand, the bonding of the layers is simultaneously utilized for fastening the mounting elements with the result that no separate process steps are necessary. If required, corresponding recesses can be milled into the panel on the site of installation and the mounting elements can be mounted therein or the mounting elements can be surface-mounted and fastened.

Preferably, the mounting elements are profiled with exactly defined and form-stable mounting spaces. The profiles are adapted to the shape of the recess respectively to the shape of the edge and preferably are formed to be U-shaped or H-shaped. On the inside, the profiles have a variety of channels, chambers and bores, in order to position and fasten the different structural units. Overall, the profiles create a uniform, preferably surrounding mounting area so that modular structural units can be disposed at optional locations.

The vertically disposed mounting elements preferably consist of plastic material because a sound decoupling of adjoining wall elements is realized, whereas, in particular at the upper horizontal edges, metallic mounting elements are used, because the wall element mounted and supported there.

Altogether the manufacturing and mounting expense is substantially reduced, because individual mounting solutions do not need to be figured out and system components are mainly used. In particular the manual manufacturing steps are substantially reduced, because a major portion is now automatized. The wall element can be also shipped as an assembly kit. Final measures of cutting the panel to size, in particular for the add-on parts, and their final mounting can be done on the site of installation as well.

In order to realize, for example, a functional exterior termination for rooms or for buildings with regard to an acceptable thermal, sound and/or fire insulation at the floor and ceiling areas, sealing modules, which seal in relation to the running rail respectively in relation to the floor, are inserted horizontally at the top and bottom of each wall element. Even slight irregularities in the floor can be compensated for by such sealing modules. Projecting and retracting is effected via a mechanism, which is operated via an automatically or manually activated drive unit. Horizontally disposed mounting elements are preferably made from metal, because the heavy and in particular load-transferring structural units are disposed at that location.

The vertical border areas of each wall element, at least in sections, are formed as a profile, in order to achieve a positive connection to the border areas of adjoining wall elements. For this purpose, mounting elements are disposed in particular at the vertical edges, wherein sealing profiles or moulded parts are mounted, which cooperate with a complementarily formed border area of the adjoining wall element and provide a soundproof and stable connection. Preferably, vertically disposed mounting elements are made from plastic material, because on account of the material a sound decoupling is thus realized.

Profiling can be made based on a tongue and groove system. Other positive configurations, such as undulated, circular, semicircular, trapezoidal, convex or concave are suitable as well. In addition joints made from rubber or magnetic materials, for example, may be placed at these borders as well.

The corresponding profiling can be done, without using a mounting element, directly through shaping measures during the manufacturing of the core.

In addition to structural sealing units, further system components can be integral with the mounting elements. Such components include further sealing strips, floor guides, power supply elements, control devices, servicing means, suspension devices, etc.

The selection of the materials of a wall element and their layering is done in particular based on weight-specific and acoustic aspects, the external layers being additionally selected based on visual and practical aspects. A complicated manufacturing of a supporting frame structure is foregone, because just the cutting to size and the connecting of the layers is required to provide the basic structure for a wall element.

The different materials of a layer are kept in stock as supplies in panel-shape and are cut to the required dimension when needed. Preferably, dimensioning in a raster measure is advantageous in this case, in order to be able to efficiently realize different dimensions. Building the basic structure of the wall element is realized by a layered arrangement of the panels and by feeding adhesives and filling compounds. Thus, the variable selection and disposition of layers and of filling compounds allow to quickly and easily satisfy specific customer needs at any time.

A wall element according to the inventive structure has a core which, on both sides, is covered by respectively one exterior shell. Preferably, the exterior shell is multi-layered and consists of an exterior cover layer, a middle layer, and an interior layer. Overall, the two exterior shells are formed to be heavy and soundproof and are sonically separated by the preferably soft core material. Through the full connection, preferably bonding, all layers and materials of the wall element are combined to a self-supporting unit. The sound insulation can be realized at a smaller expense, because the selection of appropriate materials and their assembling technique already result in a considerable improvement. With the intention to improve the rigidity of the wall element while maintaining the sound insulation, the contact surfaces of the layers, depending on the material selection, are profiled.

Through the selection of most different materials, the use of panel-shaped and foamed layers and their connection to a structure in a sandwich technique, the individual properties are advantageously combined in such a way that they sum up to a considerable improvement. The wall element has considerably higher bending and torsional rigidities, for example, than the sum of the properties when separately using the layers of the exterior shell and the core. Such structured panels are able to transfer substantial loads. In this case, the structure of the exterior shell, as well as the thickness and density of the core are decisive factors. Compared to a frame structure, the result is a reduced wall thickness and a lower weight for an increased stability.

The core material is made from a honeycomb structure, which in particular consists of paper or aluminum. Alternatively, solid material such as polystyrene foam, PU-foam, mineral wool, rock wool or the like can be used to form the core.

Preferably, the exterior shells are multi-layered. Metallic materials, such as sheet steel or sheet aluminum, and furthermore, plastic material (PVC, PC), laminar materials, fibreglass reinforced plastics (GRP), gypsum, wood, cork, etc. are suitable for the middle layer. The layer, disposed on the inside between the middle layer of the exterior shell and the core, serves as an increase in shell weight and as a damping material and preferably consists of bitumen. The cover layer middle layer serves at the same time as the support for the exterior cover layer, which forms the visible surface. This may be a priming film, a laminate, laminar material or melamine resin. Furthermore, veneers, textiles, glass or magnetic surfaces can be used to form the cover layer.

Bonding materials and bonding techniques are used for connecting the individual layers of the exterior shell. The so-called long-fibre-injection method (LFI) is used as a preferred method. In this case, fibreglass strands are cut and, in a single operational step, are fed simultaneously with PUR-components to a tool device and blended. The finished mixture is then sprayed between the corresponding layers of the exterior shell and, once hardened, creates a permanent connection.

A particularly advantageous structure of the wall element is achieved with a soft core of PUR-foam or melamine foam, which, on both sides, is surrounded by a weighting layer of bitumen. Then the middle layer of the exterior shell follows, consisting of GRP enveloped paper honeycombs filled with PU-foam, and an exterior cover layer, depending on customer specifications. Such a combination of materials has excellent acoustic properties and constitutes an optimum solution with regard to the parameters of sound insulation and weight per unit area.

Such structured wall elements are suitable to build partitioning walls having the most different configurations. In particular the substantial weight reduction achieves a lower load on the suspension devices and on the drive means. Additionally, by increasing the sound insulation, the multiplicity of application possibilities increases.

The wall elements can be formed as solid elements, passage door, angle element, window element, compensating element, swing leaf, double-action leaf or as following automatic doors. All wall elements can be moved out of the axis of the partitioning wall and parked at a predetermined location in a space-saving manner. Each wall element is displaceable by means of a carriage, at one or two points, in a running rail, which is attached to the ceiling.

The overall partitioning wall fulfils the requirements of the thermal insulation regulation such that, even at low outside temperatures, there are no disadvantages as to energy and cost.

wall element with horizontally and vertically disposed mounting elements, according to another embodiment.

Figure 1:
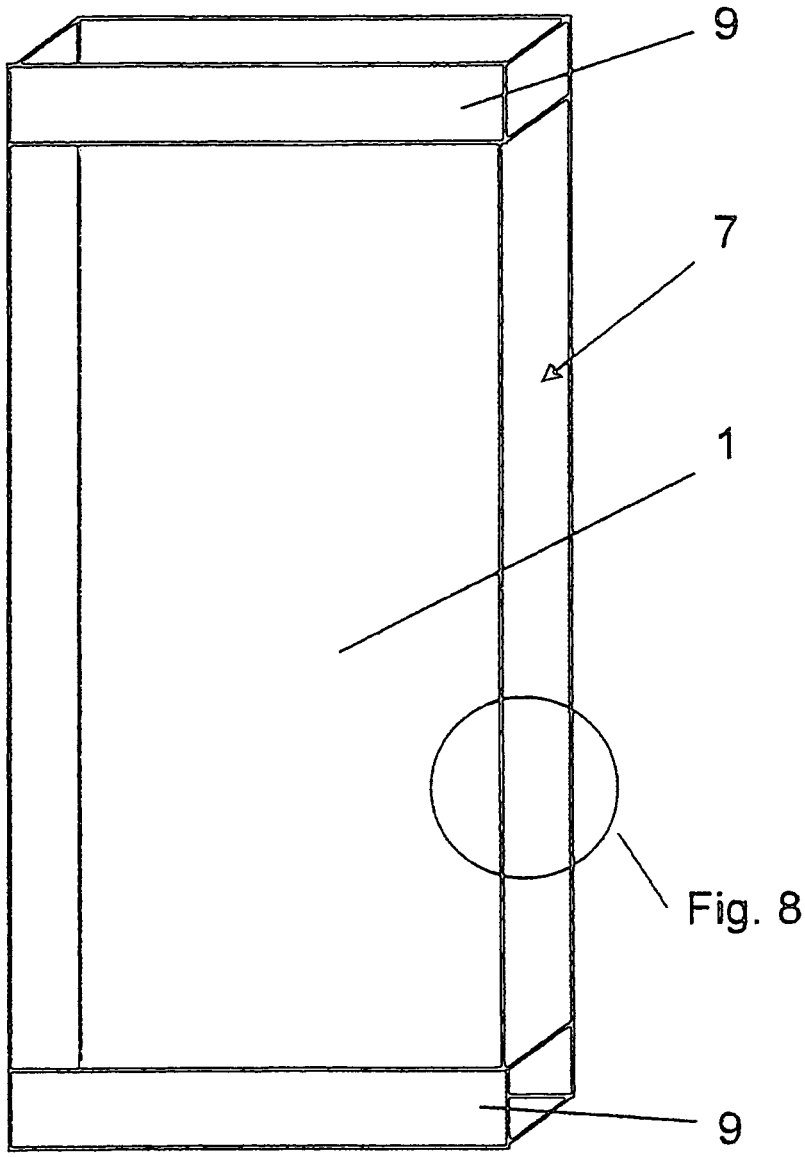
FIG. 1 shows a diagrammatical structure of a wall element.
Figure 8:
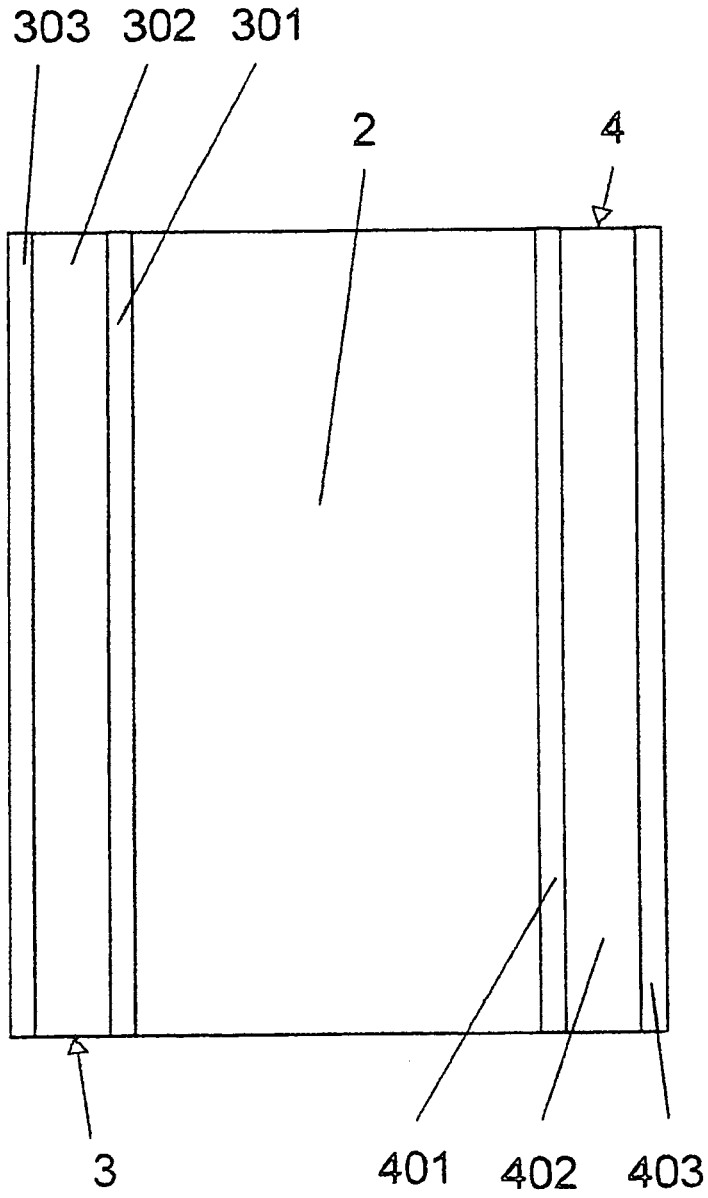

FIG. 8 shows a diagrammatical layered structure of a wall element in an enlarged illustration according to FIG. 1.

Figure 9:
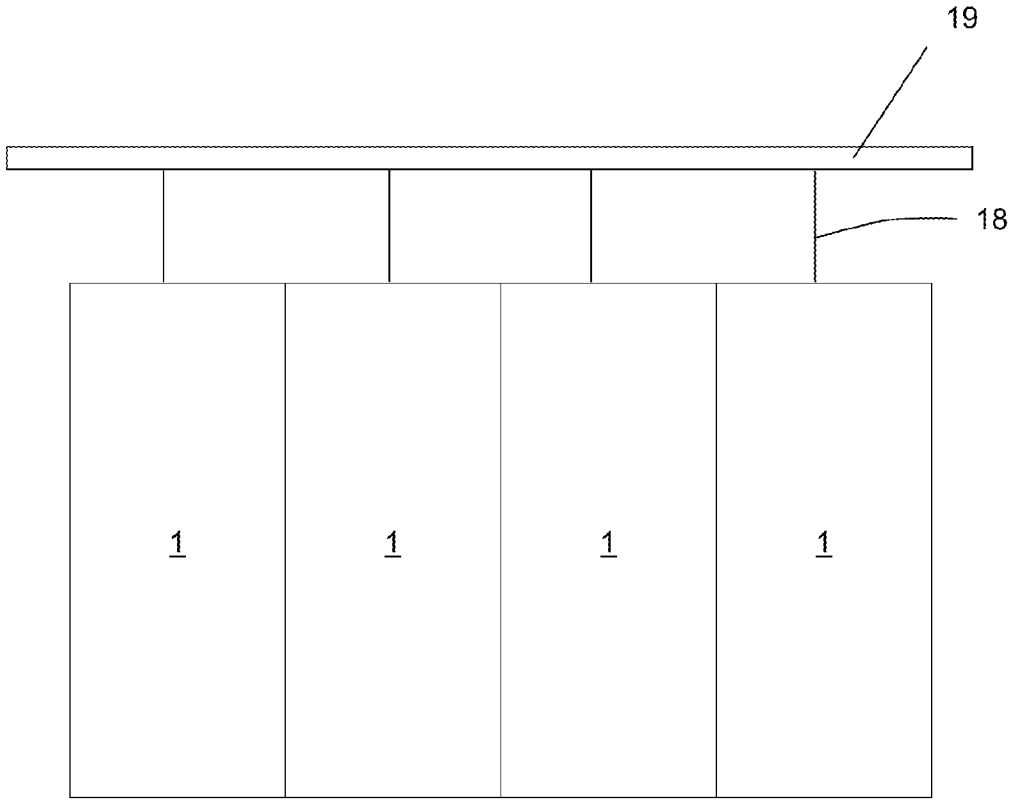

FIG. 9 shows a door assembly including the wall elements shown in FIG. 1.

DETAILED DESCRIPTION OF THE PREFERRED EMBODIMENTS

In the Figures, similar or similarly functioning structural elements are identified with the same reference numerals.

A mobile partitioning wall is composed of several panel-shaped, independently displaceable, suspendedly supported wall elements 1 and suitable for subdividing a room or as an outside termination. Depending on the embodiment, the individual wall elements may be displaced manually or driven by a motor. All wall elements can be moved out of a space saving parking position, a so-called stacking location, and into the axis of the partitioning wall and be secured there.

For the sake of clarity, in FIGS. 2 to 8, a wall element 1 is diagrammatically and partially illustrated, in order to be able to describe the respective structure in a correspondingly detailed form.

Figure 2:
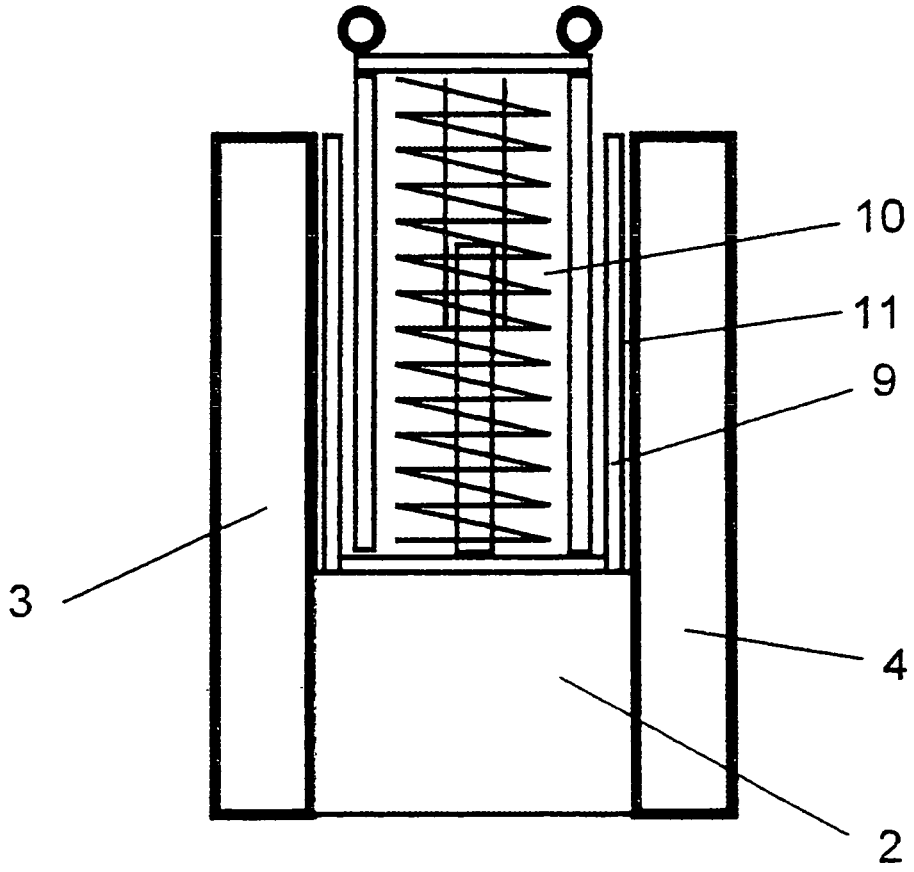
FIG. 2 partially shows a diagrammatical view of a wall element with a mounting element disposed on the top side in a recess.
Figure 3:
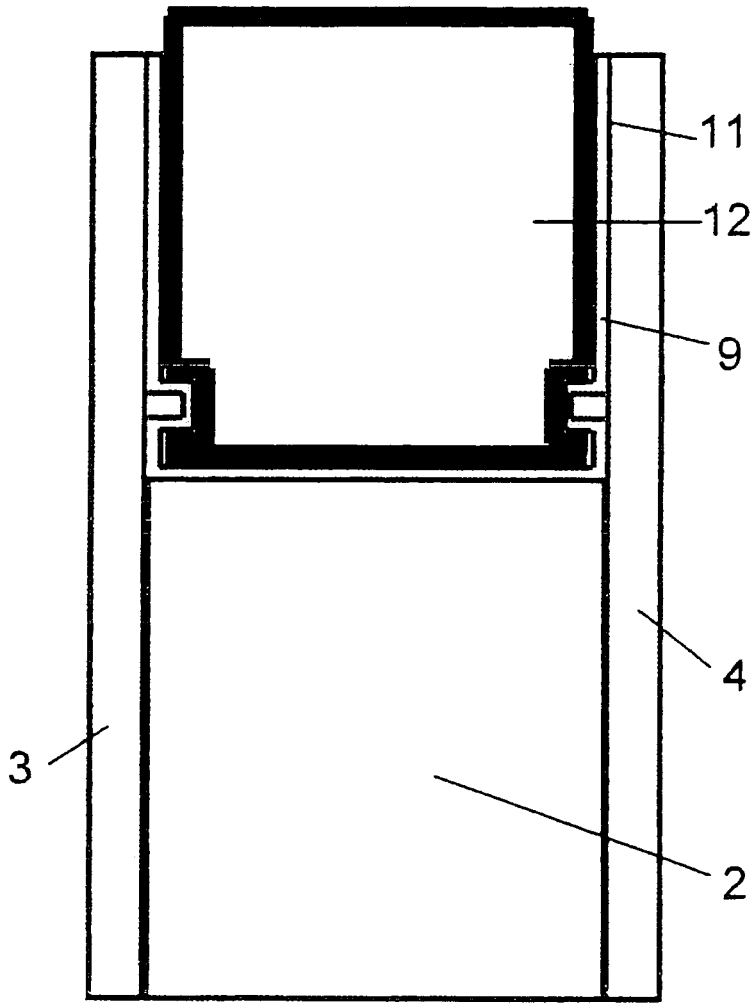
FIG. 3 partially shows a diagrammatical view of a wall element with a mounting element disposed on the top side in a recess, according to another embodiment.
Figure 4:
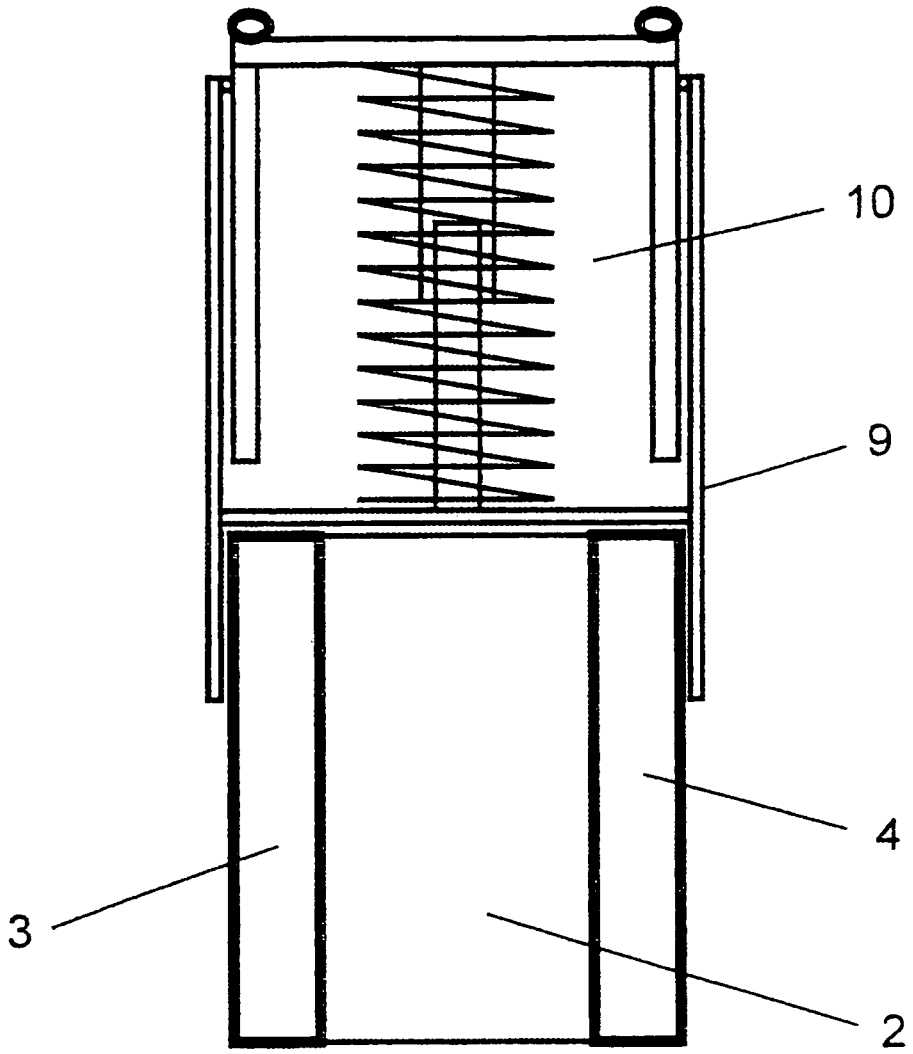
FIG. 4 partially shows a diagrammatical view of a wall element with a mounting element disposed surface-mounted on the top side.

In the FIGS. 2 to 4, wall elements 1 are illustrated having respectively one mounting element 9 disposed at their upper horizontal edge in various ways. The mounting elements 9 include for example a sealing mechanism 10 realizing a functional termination in rooms or buildings with regard to an acceptable thermal, sound and/or fire insulation in the floor and ceiling areas. For sealing purposes, the sealing mechanism 10 is pressed out of the mounting element 9 against the running rail respectively against the floor, wherein, in the inactivated condition, all structural elements, which are associated to the mechanical system, are disposed completely concealed in the respective mounting element 9. Even minor irregularities in the floor can be compensated for through the disposition of these sealing mechanisms 10. Projecting and retracting the sealing mechanisms 10 is realized via an automatically or manually activated drive unit. At the upper horizontal sides of the wall elements 1, carriages 18, which are not illustrated in more detail, are disposed, by means of which the wall elements 1 are displaceable in a running rail 19 fastened to a ceiling of a building as is shown in FIG. 9.

In this case, the mounting elements 9 house various structural units 12, such as coupling elements, lifting members, resetting members, drive elements, suspension devices, floor guides, sealing means and electrical equipment. The structural units 12, serving for the securing or the sealing of the wall element 1, are completely disposed within the mounting element 9. The system is thus suitable for use in transparent partitioning walls, because there is no visual interference with the appearance.

Further mounting elements 9' are disposed at the vertical edges of the wall elements 1. Depending on the intended utilization, the mounting elements 9' include sealing strips, power supply elements, servicing means and further system components. In particular the first and last wall elements 1 of a partitioning wall additionally have a sealing mechanism 10 at the corresponding vertical edge.

Mounting elements 9 are preferably profiled with exactly defined and form-stable mounting spaces. The profiles of the mounting elements 9 are adapted to the shape of the recess 11 and to the shape of the edge and preferably are formed to be U-shaped or H-shaped. On the inside, the profiles 9 have a variety of channels, chambers and bores, in order to be able to position and fasten the different structural units 12. Overall, the profiles of the mounting elements 9 create a uniform, preferably surrounding mounting area so that modular structural units 12 can be disposed at optional locations.

The vertically disposed mounting elements 9' preferably consist of plastic material because thereby a sound decoupling of adjoining wall elements 1 is realized, whereas, in particular at the upper horizontal edges, metallic mounting elements 9 are used, because there the wall element 1 is mounted in a supporting manner.

According to FIGS. 2 and 3, the mounting elements 9 are disposed in a groove-shaped recess 11 such as to be concealed in the wall element 1. By mounting the respective mounting element 9 and its structural units in the recess 11, they are disposed completely invisible. The recesses 11 are preferably made in the factory when realizing the basic structure of the wall element 1. The mounting element 9, preferably in the shape of a profile, is adapted to the shape of the recess 11, in this case, U-shaped, and is bonded therein.

A special embodiment is shown in FIG. 3, where the mounting element 9, in addition to the usual bonding, is additionally fastened in the recess 11. In this case, a structural unit 12 is surrounded by a housing, which is positively engaged by the mounting element 9.

The mounting element 9 according to FIG. 4 is disposed such as to be surface-mounted on the side of the edge of the wall element 1. In this embodiment, the positioning and fastening of the mounting elements 9 is achieved at the horizontal edges in a surface-mounted manner, the structural units being fastened in the mounting element 9, which is premounted on the respective edge. The mounting element 9 is adapted to the shape of the edge and is formed in an H-shape.

Figure 5:
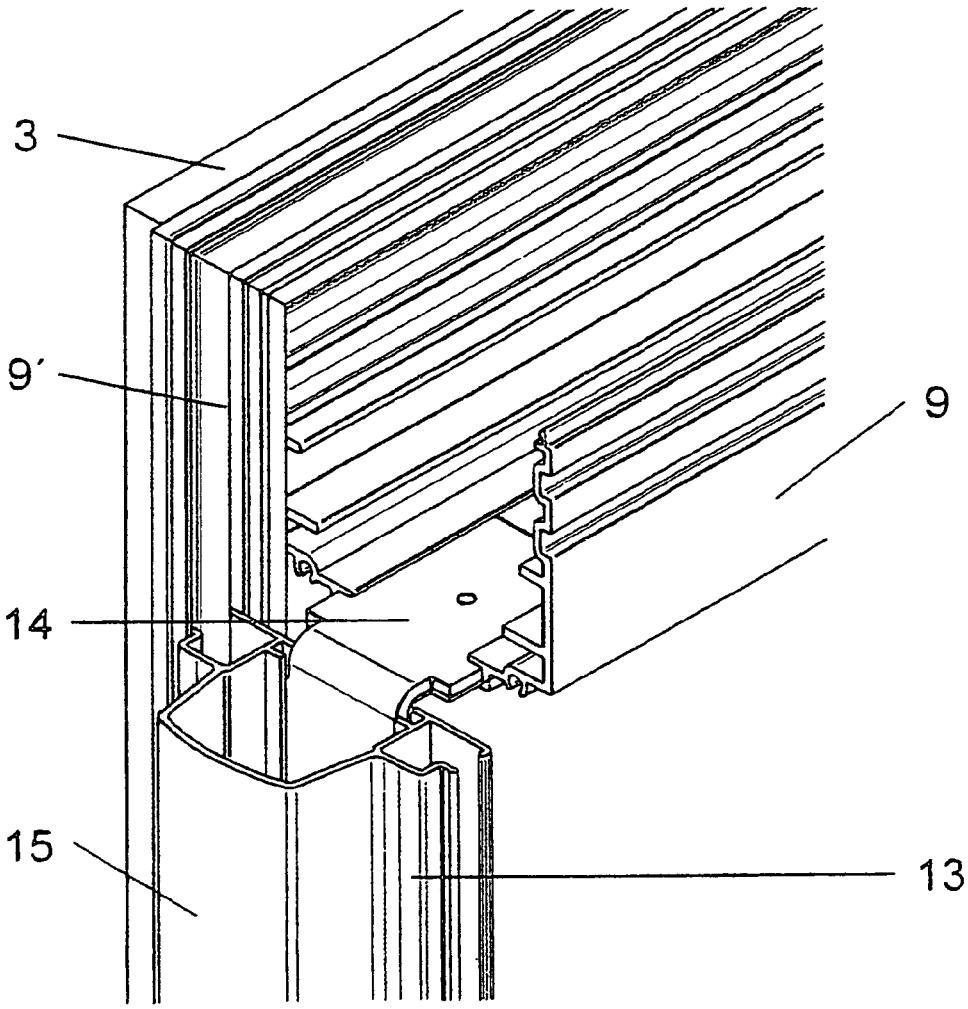
FIG. 5 partially shows a diagrammatical view of the corner of a wall element with horizontally and vertically disposed mounting elements, according to another embodiment.
Figure 6:
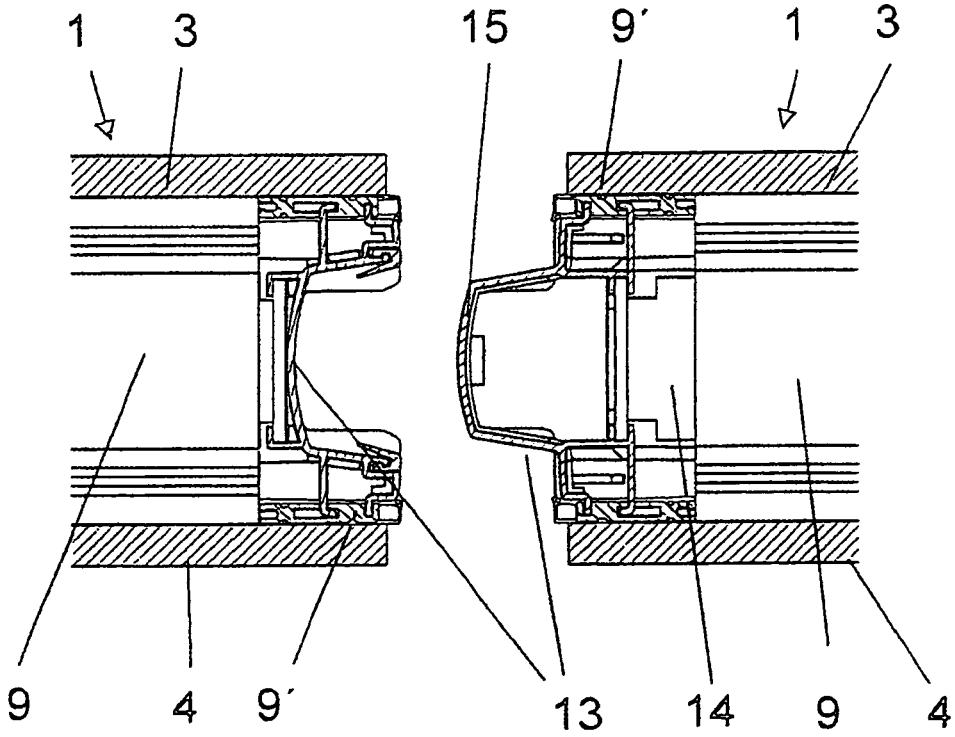
FIG. 6 partially shows an enlarged cross-section of adjoining wall elements with vertical mounting elements and sealing profiles.

FIG. 5 shows mounting elements 9 at the vertical and horizontal edges of a wall element 1. A transitional element 13, which allows for a positive transition to the border areas 7 of adjoining wall elements 1, is mounted in the vertical mounting element 9'. The horizontal mounting element 9 is made from a metallic profile, because the supporting structures to the running rail are inserted there. The vertical mounting elements 9' consist of plastic profiles fastened inside the exterior shells 3, 4, into which profiles a metallic sealing profile 13 is clipsed in. The fastening is preferably increased/reinforced by a corner angle 14 pointing to the horizontal mounting element 9. The sealing profiles 13 of adjoining wall elements 1 cooperate in a sealing manner by means of concave and convex exterior structures 15 (FIG. 6). This results in a sound-proof and stable connection. Further positive respectively complementary configurations are likewise suitable.

Further structural units 12 can be fastened in the mounting elements 9, 9', in particular in the corner area of the wall element 1. A service module 16 is disposed above the sealing profile 13, such that the energy supply from one wall element to another is guaranteed. The control contacts, current contacts and servicing indicators are integral with the service module 16. The exterior structure 15 of the sealing profiles 13 is maintained for the service module as well.

Figure 7:
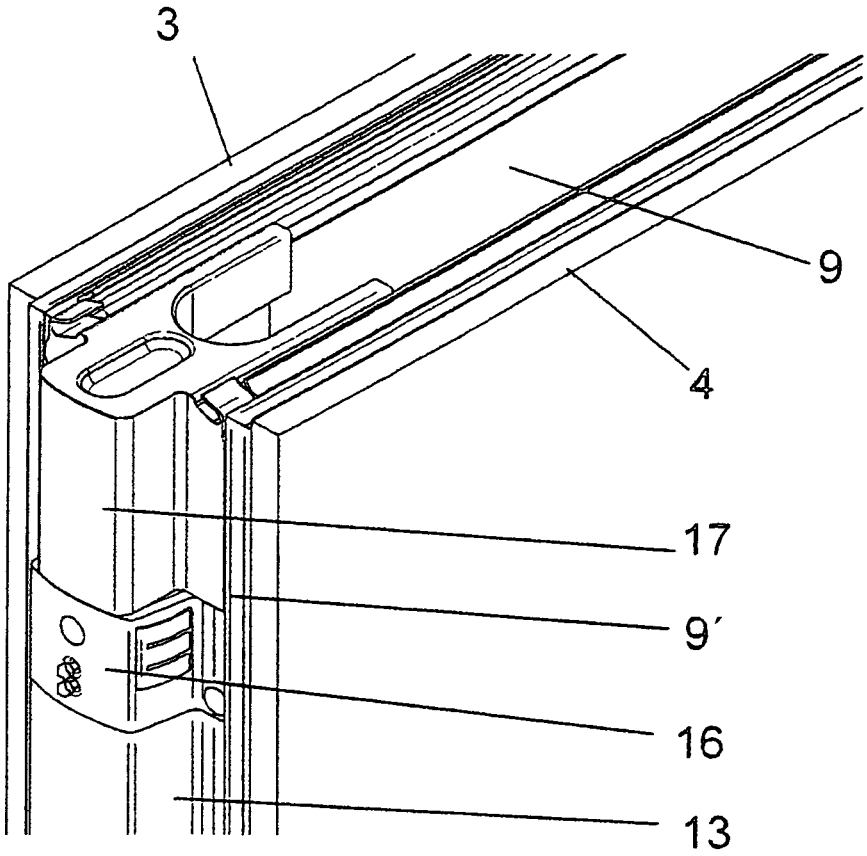

In order to guarantee an optimal sealed transition in the corner area, a molded part 17, preferably made from elastic, form-stable material, is fastened as a termination above the sealing profile 13. On the one hand, this transition is realized by clipping the part on the plastic profile of the vertical mounting element 9' and, on the other hand, positively inserting it into the horizontal mounting element 9. In a preferred embodiment, the service module 16 and the molded part 17 form one structural element (FIG. 7).

FIG. 8 illustrates the layered structure of a wall element 1. In the exemplary embodiment, the wall element 1 consists of a core 2 and of exterior shells 3, 4 disposed on both sides. This results in a homologous structure. The exterior shells 3, 4 are formed to be heavy and soundproof and are sonically separated by a preferably soft core material. In order to form a self-supporting unit, the exterior shells 3, 4 and the core 2 are combined through a full bonding.

The core 2 can have a honeycomb structure, which in particular consists of aluminum or paper. Alternatively, solid material made from polystyrene foam, PU-foam, mineral wool, rock wool or the like can be used to form the core 2.

Both exterior shells 3, 4 are multi-layered and consist respectively on the inside of a weighting and sound insulating layer 301, 401, a middle layer 302, 402 made from honeycomb-shaped material and an exterior cover layer 303, 403. The layers are bonded to each other by means of LFI filling technique.

Metallic materials, such as sheet steel or sheet aluminum, and furthermore, plastic material (PVC, PC), laminar materials (GRP), gypsum, wood, cork, etc. are suitable for the middle layers 302 and 402. The middle layers 302 and 402 serve as the support for the visible cover layers 303 and 403. The cover layers 303 and 403 can be formed of a priming film, laminate, laminar materials, or melamine resin. Furthermore, veneers, textile or glass surfaces can be used to form the cover layers 303 and 403.

A particularly advantageous structure of the wall element 1 is achieved with a soft core made from PUR integral foam or melamine foam. Preferably, the mass amounts to 25 to 75 kg/m$^3$ with a thickness of 40 to 80 mm. Preferably, the weight per unit area amounts to 10 to 40 kg/m$^2$. A weighting layer 301, 401 made from bitumen is disposed on both sides and has a thickness of about 5 to 8 mm and a weight per unit area of about 5 to 15 kg/m$^2$. The following middle layer 302, 402 is made from GRP enveloped honeycomb paper filled with PU-foam. Finally the exterior cover layer 303, 403, which is 1 to 4 mm thick, is applied on both sides. Such a combination of materials has excellent acoustic properties, which constitute the optimum solution with regard to the parameters of sound insulation and the weight per unit area, such as to reach a sound insulation factor of about 55 dB.

The invention claimed is:

1. A mobile partitioning wall comprising:

a plurality of wall elements displaceably suspended at one or more running rails, each of said plurality of wall elements having a layered structure and comprising a core sandwiched between two exterior shells disposed on opposing sides of the core and fully bonded to the core, the layered structure having upper and lower horizontal side edges and lateral vertical side edges and being formed without a supporting frame;

at least one horizontal mounting element disposed at least one of the upper and lower horizontal side edges and vertical mounting elements disposed at the vertical side edges of each of said wall elements and each having a mounting area;

at least one horizontal sealing mechanism supported in and operable to move in and out of said mounting area in said at least one of the upper and lower horizontal side edges;

vertical sealing profiles supported at the respective vertical mounting elements; and corner sealing parts clipped to the respective vertical mounting elements and directly received in said mounting area in the at least one horizontal mounting element, thereby forming a sealed transition from the respective vertical mounting elements to the at least one horizontal mounting element.

2. The mobile partitioning wall of claim 1, wherein at least one of the horizontal and vertical side edges is formed with recesses which receive the mounting elements.

3. The mobile partitioning wall of claim 2 wherein the horizontal side edges are formed with recesses which receive the mounting elements.

4. The mobile partitioning wall of claim 3 wherein the mounting elements are bonded in the recesses.

5. The mobile partitioning wall of claim 3 wherein the mounting elements are U-shaped.

6. The mobile partitioning wall of claim 5 further comprising a structural element in a housing received in the U-shaped mounting element, wherein the housing is positively engaged by the mounting element.

7. The mobile partitioning wall claim 1, wherein the mounting elements are surface mounted on at least one of the horizontal and vertical mounting edges.

8. The mobile partitioning wall of claim 7, wherein the mounting elements are H-shaped.

9. The mobile partitioning wall of claim 1 wherein the mounting elements are disposed at each of the horizontal and vertical side edges.

10. The mobile partitioning wall of claim 9 wherein the mounting elements on the vertical side elements are plastic.

11. The mobile partitioning wall of claim 9 wherein the mounting elements on the vertical side edges receive complementary sealing profiles, whereby the sealing profile on one said wall element is received in the complementary sealing profile of an adjacent said wall element.

12. The mobile partitioning wall of claim 11 wherein the sealing profiles engage in channels formed in the mounting elements on the vertical side edges.

13. The mobile partitioning wall of claim 11 further comprising corner connectors connecting the sealing profiles to the mounting elements on the horizontal edge sides.

14. The mobile partitioning wall of claim 11 wherein the corner sealing parts are molded sealing parts clipped to the mounting elements on the vertical side edges adjacent to the vertical sealing profiles, and inserted in the mounting elements on the horizontal side edges.

15. The mobile partitioning wall of claim 11 further comprising service modules fixed to respective ones of said mounting elements on said vertical side edges, each said service module having electrical contacts which can contact the electrical contacts of the service module on an adjacent wall element.

16. The mobile partitioning wall of claim 9 wherein the mounting elements on the vertical side edges are plastic, and the sealing mechanism comprises metal sealing elements, the sealing elements being snapped into the mounting elements.

* * * * *